US010570729B2

(12) United States Patent
Santarelli

(10) Patent No.: US 10,570,729 B2
(45) Date of Patent: Feb. 25, 2020

(54) THERMALLY INDUCED LOW FLOW RATE FRACTURING

(71) Applicant: Geomec Engineering Ltd., London (GB)

(72) Inventor: Frederic Joseph Santarelli, Stavanger (NO)

(73) Assignee: GEOMEC ENGINEERING LIMITED, London (GB)

( * ) Notice: Subject to any disclaimer, the term of this patent is extended or adjusted under 35 U.S.C. 154(b) by 266 days.

(21) Appl. No.: 15/573,997

(22) PCT Filed: Jun. 2, 2016

(86) PCT No.: PCT/GB2016/051621
§ 371 (c)(1),
(2) Date: Nov. 14, 2017

(87) PCT Pub. No.: WO2016/193729
PCT Pub. Date: Dec. 8, 2016

(65) Prior Publication Data

US 2018/0266227 A1 Sep. 20, 2018

(30) Foreign Application Priority Data

Jun. 3, 2015 (GB) ..... 1509576.3
Jun. 3, 2015 (GB) ..... 1509579.7
Aug. 3, 2015 (GB) ..... 1513655.9

(51) Int. Cl.
*E21B 49/00* (2006.01)
*E21B 43/267* (2006.01)
(Continued)

(52) U.S. Cl.
CPC ..... *E21B 49/00* (2013.01); *E21B 43/26* (2013.01); *E21B 43/267* (2013.01); *E21B 47/06* (2013.01);
(Continued)

(58) Field of Classification Search
CPC ..... E21B 49/00; E21B 43/267; E21B 43/25; E21B 43/26; E21B 47/065; E21B 47/06;
(Continued)

(56) References Cited

U.S. PATENT DOCUMENTS 2,952,449 A 9/1960 Bays
3,285,342 A 11/1966 Cronberger
(Continued)

FOREIGN PATENT DOCUMENTS

CA 2013726 A1 10/1990
CA 2240580 C 1/2001
(Continued)

OTHER PUBLICATIONS

EPO as Int'l Search Authority; International Search Report for PCT/GB2016/051621; dated Sep. 12, 2016; entire document; Rijswijk, The Netherlands.
(Continued)

*Primary Examiner* — Wei Wang
(74) *Attorney, Agent, or Firm* — Law Office of Jesse D. Lambert, LLC

(57) ABSTRACT

A method of increasing hydrocarbon production by hydraulic fracturing in shale formations by using an a-seismic process of cyclic injection of cooled aqueous fluid at a low rate with shut-in periods to induce tensile failure in the formation and create a fracture network of high and very high conductivity fractures with sufficient lateral extension in a completed well. A final single cycle of aqueous fluid and proppant is used in which the volume of proppant has been determined from measurements of the downhole pressure. Further fracture parameters being: volume of the very high conductivity fractures, lateral extension of the very high conductivity fractures, surface of the very high conductivity
(Continued)

fractures and estimation of the global fracture network shape are determined and analysed after each injection cycle.

20 Claims, 6 Drawing Sheets

(51) Int. Cl.

| | |
|---|---|
| ***E21B 47/06*** | (2012.01) |
| ***E21B 43/26*** | (2006.01) |
| ***E21B 33/12*** | (2006.01) |
| ***E21B 43/11*** | (2006.01) |
| ***E21B 43/14*** | (2006.01) |

(52) U.S. Cl.
CPC ..... *E21B 47/065* (2013.01); *E21B 33/12* (2013.01); *E21B 43/11* (2013.01); *E21B 43/14* (2013.01)

(58) Field of Classification Search
CPC ..... E21B 43/14; E21B 43/11; E21B 33/12; E21B 49/008
See application file for complete search history.

(56) References Cited

U.S. PATENT DOCUMENTS

| | | | |
|---|---|---|---|
| 3,501,201 | A | 3/1970 | Clossman et al. |
| 4,549,608 | A | 10/1985 | Stowe et al. |
| 4,660,643 | A | 4/1987 | Perkins |
| 4,802,144 | A | 1/1989 | Holzhausen et al. |
| 4,834,181 | A | 5/1989 | Uhri et al. |
| 4,858,130 | A | 8/1989 | Widrow |
| 5,070,457 | A | 12/1991 | Poulsen |
| 5,170,378 | A | 12/1992 | Mellor et al. |
| 8,978,764 | B2 | 3/2015 | Dusseault et al. |
| 2006/0201674 | A1 | 9/2006 | Soliman et al. |
| 2007/0083331 | A1 | 4/2007 | Craig |
| 2012/0267096 | A1 | 10/2012 | Pershikova |
| 2013/0197810 | A1 | 8/2013 | Haas et al. |
| 2014/0058686 | A1 | 2/2014 | Anderson et al. |
| 2014/0238668 | A1 | 8/2014 | Bittleston et al. |
| 2014/0299318 | A1 | 10/2014 | Crews et al. |
| 2015/0068746 | A1 | 3/2015 | Abass et al. |
| 2015/0129211 | A1 | 5/2015 | Dusseault et al. |

FOREIGN PATENT DOCUMENTS

| | | | |
|---|---|---|---|
| EP | 2527586 | A1 | 11/2012 |
| EP | 2700785 | A2 | 2/2014 |
| GB | 2050467 | A | 1/1981 |
| GB | 2231405 | A | 11/1990 |
| WO | 2008004172 | A2 | 1/2008 |
| WO | 2008093264 | A1 | 8/2008 |
| WO | 2009086279 | A2 | 7/2009 |
| WO | 2012068397 | A2 | 5/2012 |
| WO | 2014004611 | A2 | 1/2014 |
| WO | 2014022587 | A2 | 2/2014 |
| WO | 2014055273 | A1 | 4/2014 |
| WO | 2016069114 | A1 | 5/2016 |

OTHER PUBLICATIONS

EPO as Int'l Search Authority; Written Opinion of the Int'l Searching Authority for PCT/GB2016/051621; dated Sep. 12, 2016 (est.); entire document; Munich, Germany.

Intellectual Property Office of the UK Patent Office; Search Report for GB1509579.7; dated Sep. 14, 2015; entire document; United Kingdom.

EPO as Int'l Search Authority; International Search Report for PCT/GB2016/051625; dated Sep. 9, 2016; entire document; Rijswijk, The Netherlands.

EPO as Int'l Search Authority; Written Opinion of the Int'l Searching Authority for PCT/GB2016/051625; dated Sep. 9, 2016 (est.); entire document; Munich, Germany.

Intellectual Property Office of the UK Patent Office; Search Report for GB1513655.9; dated Jan. 31, 2016; entire document; United Kingdom.

Society of Petroleum Engineers; SPE 24824, "Fracture Measurement Using Hydraulic Impedance Testing"; Oct. 4-7, 1992; entire document; Washington, D.C., US.

Society of Petroleum Engineers; SPE/ISRM 47329, "Sand Production on Water Injectors: Just How Bad Can it Get?"; Jul. 8-10, 1996; entire document; Trondheim, Norway.

EPO as Int'l Search Authority; International Search Report for PCT/GB2016/051624; dated Sep. 9, 2016; entire document; Rijswijk, The Netherlands.

EPO as Int'l Search Authority; Written Opinion of the Int'l Searching Authority for PCT/GB2016/051624; dated Sep. 9, 2016 (est.); entire document; Munich, Germany.

Intellectual Property Office of the UK Patent Office; Search Report for GB1509576.3; dated Sep. 7, 2015; entire document; United Kingdom.

THERMALLY INDUCED LOW FLOW RATE FRACTURING

The present invention relates to the extraction of hydrocarbons by hydraulic fracturing in shale formations and more particularly, to a largely a-seismic process of cyclic injection of cooled fluid at a low rate with shut-in periods to induce tensile failure in the formation and create a fracture network of high and very high conductivity fractures in a completed well.

There is now a sustained interest in so-called unconventional resources to meet our energy needs. As a result, techniques have been developed to stimulate the production of hydrocarbons from low-permeability sub-surface formations such as shale, marl, siltstone, etc. In a typical arrangement a well is drilled providing a horizontal leg through a known shale formation below the cap rock.

The well is then perforated and stimulated at intervals along the drain length with each interval being plugged prior to the next being perforated and stimulated by performing a frac job. 30 to 40 intervals are common with 100 m being a typical separation distance between intervals. At the end of the process, the entire well is then opened to production. The pumped fluid used in the frac jobs is back produced followed by hydrocarbon flow.

In a typical frac job, water or viscosified water in the form of a gel is injected at a relative high initial rate, say 10 bpm. The pumping rate is ramped up in steps of around 20 bpm to achieve a maximum pumping rate of 100 to 200 bpm. This stepped approach is used to shock the formation and open pre-existing natural fractures in the formation. At this high pumping rate, a proppant is then added to the water, to fill the fractures, keeping them open for production. The proppant is sand or engineered ceramic particles which are sized to provide support while also allowing flow of hydrocarbons i.e. shale oil and/or gas. Pumping is continued until the supply of proppant is exhausted or screen out occurs as you have run out of pump pressure.

In the stimulation process, if naturally occurring hydrocarbon-filled fractures are present at an interval, these can be produced. However, the production from each interval can vary greatly. This is in part due to the fact that while fracture traces can be identified at the well bore wall by logging, such logs do not indicate the lateral extension of the fractures and it is the lateral extensions which determine the hydrocarbon production capacity. It is presently estimated that around 50% of intervals which are stimulated do not produce any hydrocarbons due primarily to the lack of naturally occurring hydrocarbon-filled fractures with sufficient lateral extension at the interval.

US 2013/0284438 to Dusseault and Bilak relates to a method of generating a network of fractures in a rock formation for extraction of hydrocarbon or other resource from the formation. The method includes the steps of i) enhancing a network of natural fractures and incipient fractures within the formation by injecting a non-slurry aqueous solution into the well under conditions suitable for promoting dilation, shearing and/or hydraulic communication of the natural fractures, and subsequently ii) inducing a large-fracture network that is in hydraulic communication with the enhanced natural fracture network by injecting a plurality of slurries comprising a carrying fluid and sequentially larger-grained granular proppants into said well in a series of injection episodes. This method is based on causing shear failure in a network of native and incipient fractures in the formation. It also claims that further injection of a non-slurry aqueous solution into the well will extend a zone of self-propped fractures.

It is an object of the present invention to provide a method of creating a fracture network of very high conductivity fractures with sufficient lateral extension in a formation at an interval in a completed well to improve stimulation efficiency and consequently hydrocarbon production.

According to a first aspect of the present invention there is provided a method of increasing hydrocarbon production by hydraulic fracturing in a well, the well having at least one perforated interval exposing rock in a formation and at an interval, the method comprising the steps of: injecting an aqueous fluid into the formation followed by injecting an aqueous fluid and proppant into the formation, characterised in that:

there are a plurality of cycles of injecting the aqueous fluid followed by injecting the aqueous fluid and a volume of proppant in a single cycle with each cycle terminating in a shut-in period;

the volume of proppant is determined from measurement of downhole pressure;

and the process is a-seismic in that the injection rate is low to prevent shocking the formation and the temperature of the injected aqueous fluid is low to induce tensile failure in the rock and thereby provide a fracture network of very high conductivity fractures and high conductivity fractures with sufficient lateral extension for hydrocarbon production.

In this way, each aqueous fluid injection cycle will induce fractures on the surfaces of the existing fractures and thus laterally extend the network. As the induced fractures are formed from existing fractures the resultant network has high conductivity. Very high conductivity fractures lie around the well, are filled with proppant in the final cycle and are the main conduit of permeability, effectively increasing the well volume. Extending from the very high conductivity fractures are high conductivity fractures which provide increased lateral extension, are not propped, and though they may partly close on production of the well, will still contribute hydrocarbon production feeding the very high conductivity fractures. Of note, however, is the 'fractal-like' or 'man-made' nature of the fractures created. These are man-made by virtue of the shut-in period followed by injection of cooler aqueous fluid, there being a thermal component of stress working along the fracture boundary which weakens it, so allowing further fractures to be formed. This is in contrast to the prior art use of shear failure which occurs on existing and incipient fractures to open them.

Preferably, the injection rate for pumping the aqueous fluid is less than 15 bpm (barrels per minute). The injection rate may be less than 10 bpm. The injection rate may be in the range 4 to 15 bpm. For one or more cycles the injection rate may be less than 2 bpm. More preferably, the injection rate is less than 1 bpm. The injection rate may vary in each cycle. In this way, the formation does not encounter shock on pumping the aqueous fluid. Injection rates for traditional hydraulic fracturing are typically in the range of 50 to 200 bpm as it is intended to shock the formation to open up the fractures. Advantageously, the low injection rate is equivalent to pumping from 1 or 2 high pressure pumps as compared to the 30 to 50 typically needed for traditional hydraulic fracturing. The injection rate for pumping the aqueous fluid and proppant may be high i.e. more typical of the 50 to 200 bpm of traditional hydraulic fracturing. This higher rate speeds up the final cycle.

Preferably, the temperature of the aqueous fluid is sufficient to create the thermal stress required to form new fractures. The aqueous fluid may be cooled before injection. This cooling may be achieved by leaving the aqueous fluid for a period of time prior to injection. Such an approach is required if the aqueous fluid has been taken from a heated source e.g. another well. Preferably, the temperature of the aqueous fluid is lower than a temperature of the formation at the interval. Consequential heating of the aqueous fluid as it is injected and pumped to the interval may be accounted for in determining the temperature of the aqueous fluid. More preferably a downhole temperature gauge is used to determine temperature at the interval.

Preferably the injection rate for pumping the aqueous fluid, injection duration, pressure and shut-in period duration for each cycle are determined from analysis of fracture parameters calculated from previous cycles.

Preferably, the fracture parameters are selected from a group comprising one or more of: volume of the very high conductivity fractures, lateral extension of the very high conductivity fractures, surface of the very high conductivity fractures and estimation of the global fracture network shape. Preferably, all the fracture parameters are calculated after each injection cycle of the aqueous fluid.

Preferably, the downhole pressure is measured using a downhole pressure gauge located in the well wherein the downhole pressure gauge has a data collection rate of at least 1 Hz. In this way a data point for calculations of the fracture parameters collected every second. More preferably, the data collection rate is between 1 and 10 Hz. The data collection rate may be between 10 and 100 Hz. This is a high data acquisition rate compared to prior art measurements. As most gauges are now digital, such data collection rates are available but not used on the basis of the excessive quantity of data which would be collected over the time scales typically used in the industry.

Preferably, at shut-in, the injection rate is reduced in a step-wise manner. More preferably, the injection rate at a final step prior to final shut-in is less than 2 bpm. Preferably each step is completed in around 1 to 5 minutes.

Preferably at a start of each cycle, the injection rate of aqueous fluid is less than 2 bpm. More preferably the injection rate of aqueous fluid is in the range of 0.5 to 2 bpm.

Preferably the volume of proppant is determined from the calculation of the volume of the very high conductivity fractures. As the proppant fills these very high fractures only, proppant volume will be a percentage of the volume of the very high conductivity fractures, with the remaining percentage made up of aqueous fluid. The volume of proppant may be calculated to be in the range of 30% to 70% of the volume of the very high conductivity fractures.

Preferably the aqueous fluid is water. More preferably the aqueous fluid is produced water from another well. The other well may be a conventional or unconventional well. The aqueous fluid may be seawater. In this way, the aqueous fluid may be whatever is available at the well and thus freshwater does not have to be brought to the well. Preferably the aqueous fluid contains no chemical additives to adjust the viscosity. This reduces cost and time in making aqueous fluid solutions. The aqueous fluid may contain a bactericide to prevent souring as is known in the industry. Preferably the proppant is as traditionally used and known to those skilled in the art. The proppant may be sand, ceramic, resin coated or not, etc.

Preferably the method includes the steps of plugging the interval, perforating and stimulating subsequent intervals along the well bore using the injection cycling steps of the first aspect, unplugging the well, back producing the aqueous fluid and producing hydrocarbons.

The method may be performed at intervals which have previously been stimulated by hydraulic fracturing. This may be considered as re-fracking.

Accordingly, the drawings and description are to be regarded as illustrative in nature and not as restrictive. Furthermore, the terminology and phraseology used herein is solely used for descriptive purposes and should not be construed as limiting in scope languages such as including, comprising, having, containing or involving and variations thereof is intended to be broad and encompass the subject matter listed thereafter, equivalents and additional subject matter not recited and is not intended to exclude other additives, components, integers or steps. Likewise, the term comprising, is considered synonymous with the terms including or containing for applicable legal purposes. Any discussion of documents, acts, materials, devices, articles and the like is included in the specification solely for the purpose of providing a context for the present invention. It is not suggested or represented that any or all of these matters form part of the prior art based on a common general knowledge in the field relevant to the present invention. All numerical values in the disclosure are understood as being modified by "about". All singular forms of elements or any other components described herein are understood to include plural forms thereof and vice versa.

While the specification will refer to up and down along with uppermost and lowermost, these are to be understood as relative terms in relation to a wellbore and that the inclination of the wellbore, although shown vertically in some Figures, may be inclined. This is known in the art of horizontal wells and in particular for shale formations.

Embodiments of the present invention will now be described, by way of example only, with reference to the accompanying Figures, of which:

FIG. 5(*a*) is a schematic illustration of thermal stresses in the fracture of FIG. 5(*a*) during shut-in and FIG. 5(*b*) is a corresponding graph illustrating the thermal stresses during shut-in;

Figure 1:
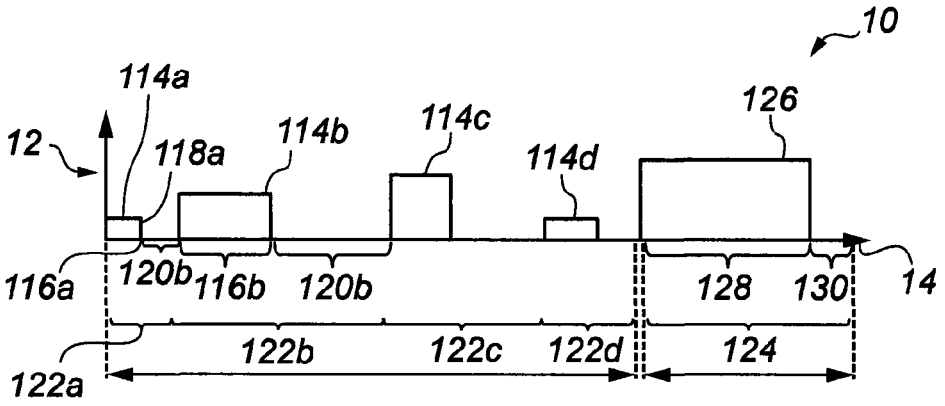
FIG. 1 is a graph of a methodology for increasing hydrocarbon production from a well by hydraulic fracturing, according to an embodiment of the present invention.
Figure 2:
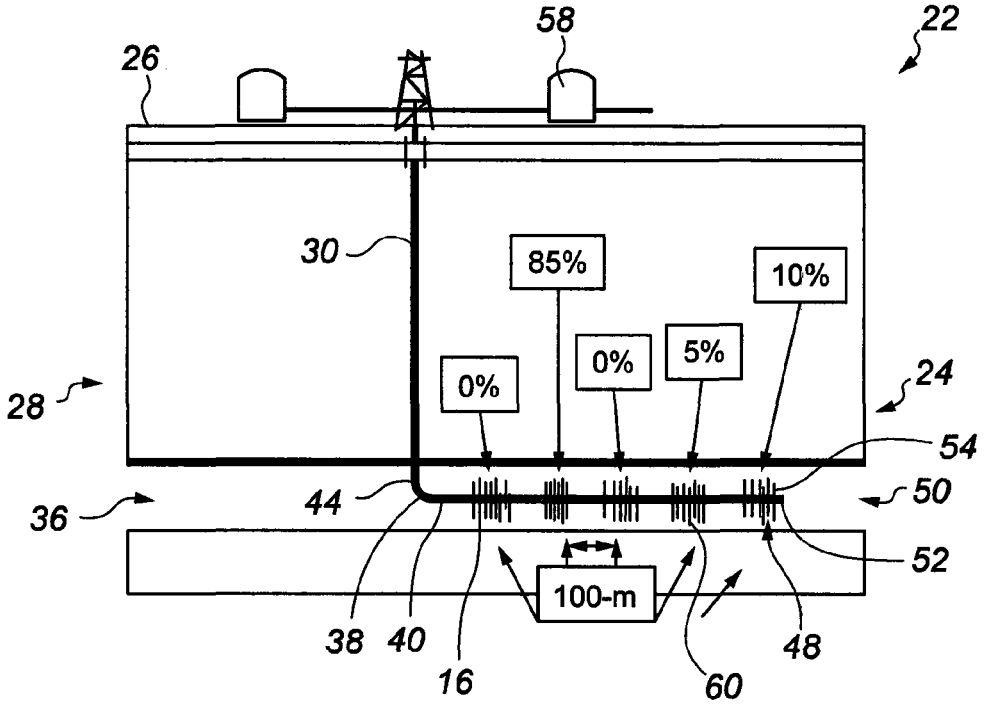
FIG. 2 is a schematic illustration of a well stimulated by hydraulic fracturing according to the prior art.
Figure 6:
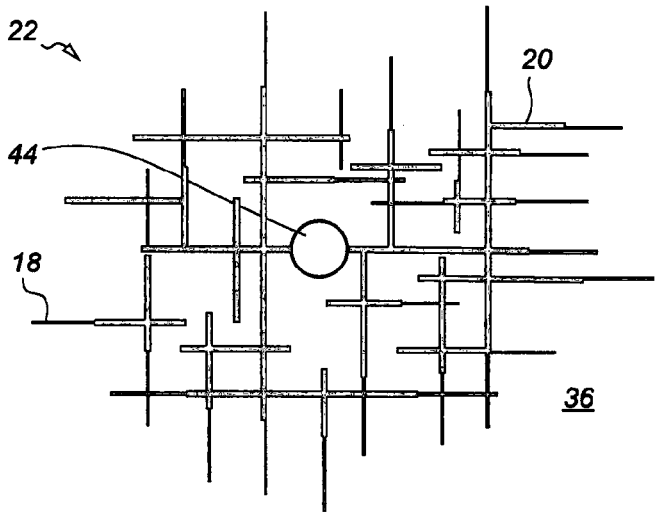
FIG. 6 is a schematic illustration of a fracture network around a well according to an embodiment of the present invention.

Referring to FIG. 1, there is illustrated a methodology, generally indicated by reference numeral 10, in the form of a graph of injection rate 12 against time 14 for creating a fracture network 16 of high and very high conductivity fractures 18,20 with sufficient lateral extension, as illustrated in FIG. 6, in a well 22, as illustrated in FIG. 2, to increase hydrocarbon production through stimulation by hydraulic fracturing, according to an embodiment of the present invention.

At FIG. 2 there is illustrated a well 22 stimulated by hydraulic fracturing. Well 22 has been drilled in the conventional manner from a surface 26 through the earth formations 28. The well 14 is shown with an initial vertical wellbore 30 which is drilled through the fresh water protection layer 32 and cap rock 34 to reach an identified shale formation 36. The wellbore 30 is then drilled horizontally to access a maximum available volume of the shale formation layer 36. In completing the well 22, tubing 38 will have been inserted into the borehole 44 at the shale formation 36, the tubing 38 being cemented in place creating a barrier in the form of a cement sheath between the outer surface 40 of the tubing and the inner surface 42 of the borehole 44. At surface 26, there will be a wellhead 46, which provides a conduit for entry and exit of the wellbore 30.

With the well 22 completed, a first interval 48 is selected. The first interval 48 is typically at the far end 50 of the drain length 52. The first interval 48 is perforated to provide access between the shale formation 36 and the inside 54 of the tubing 38. Such exposure of the formation 36 allows a frac job 56 to be performed.

In a typical frac job 56, water or viscosified water in the form of a gel is injected at a relative high initial rate, say 10 bpm. The pumping rate is ramped up in steps of around 20 bpm to achieve a maximum pumping rate of 100 to 200 bpm. This stepped approach is used to shock the formation and open the natural fractures. At this high pumping rate, a proppant is then added to the water, to fill the fractures, keeping them open for production. The proppant is sand or engineered ceramic particles which are sized to provide support while also allowing flow of hydrocarbons i.e. shale oil and/or gas. Pumping is continued until the supply of proppant is exhausted or screen out occurs as you have run out of pump pressure.

Following the frac job 56, the first interval 48 is then plugged 62 to block access to the formation 36. A second interval 60 is then perforated. The second interval 60 is spaced apart from the first interval 48, 100 m may be a typical separation distance, and located downstream of the first interval 48.

A frac job 56 is performed in the same manner on the second interval 60 and the process of plugging then perforating and stimulating by performing a frac job on subsequent intervals is repeated along the drain length 52. Though only a few intervals are illustrated in FIG. 2, 30 to 40 intervals are more common to ensure maximum extraction of available hydrocarbons.

At the end of the process, the entire well is then opened to production. The pumped fluid is back produced followed by hydrocarbon flow.

As indicated in FIG. 2, the quantity of hydrocarbons 58 produced by each interval varies greatly. It is known to those skilled in the art that up to 50% of the intervals will not produce any hydrocarbons 58. This is due to a lack of fractures 18,20 with sufficient lateral extension in the formation being present at an interval.

Thus it is realised that if a method could be found to create a fracture network 16 at each interval having fractures 18,20 with sufficient lateral extension, hydrocarbons 58 would be produced from every interval. This would increase hydrocarbon production from a well 22.

Figure 3:
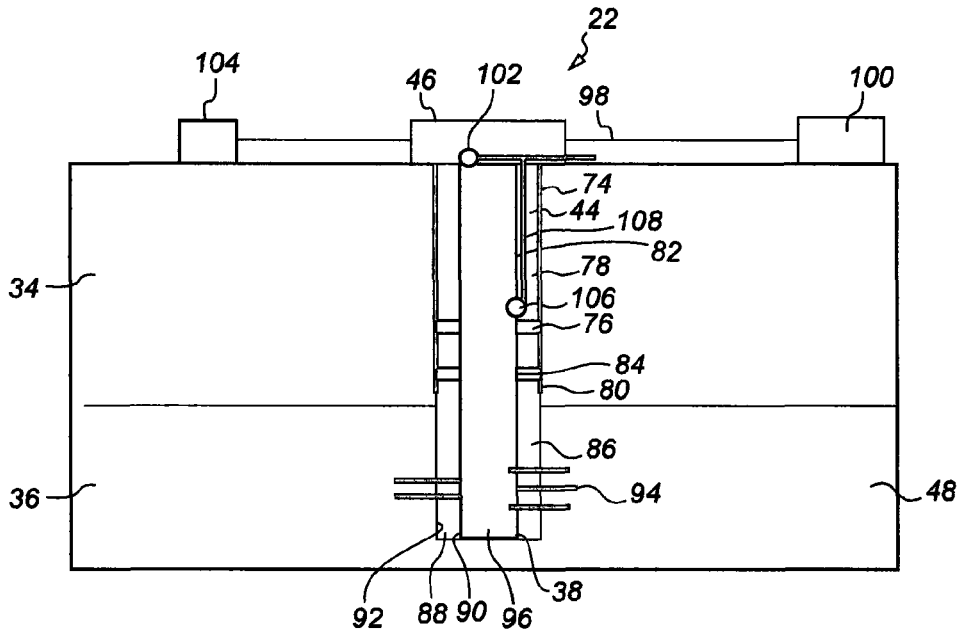
FIG. 3 is a schematic illustration of a well in which the method of the present invention is to be performed.

Such a method 10 is provided in the present invention. The technical requirements for the method 10 are illustrated in FIG. 3. This Figure is a simplified version of FIG. 2 and like parts have been given the same reference numeral to aid clarity. In FIG. 3, the well 22 is shown as entirely vertical with a single interval 48, but it will be realised that the well 22 could be effectively horizontal in practise. Dimensions are also greatly altered to highlight the significant areas of interest. Well 22 is drilled in the traditional manner providing a casing 74 to support the borehole 44 through the length of the cap rock 34 to the location of the shale formation 36. Standard techniques known to those skilled in the art will have been used to identify the location of the shale formation 36 and to determine properties of the well 22.

Production tubing 82 is located through the casing 74 and tubing 38, in the form of a production liner, is hung from a liner hanger 80 at the base 84 of the production tubing 82 and extends into the borehole 44 through the shale formation 36. A production packer 76 provides a seal between the production tubing 82 and the casing 74, preventing the passage of fluids through the annulus 78 therebetween. Cement is pumped into the annulus 88 between the outer surface 90 of the production liner 38 and in the inner wall 92 of the open borehole 44. This cement forms a cement sheath 86 in the annulus 88. When all in place, perforations 94 are created through the production liner 38 and the cement sheath 86 to expose the formation 36 to the inner conduit 96 of the production liner 38. All of this is performed as the standard technique for drilling and completing a well 22 in a shale formation 36.

At surface 26, there is a standard wellhead 46. Wellhead 46 provides a conduit (not shown) for the passage of fluids such as hydrocarbons from the well 22. Wellhead 46 also provides a conduit 98 for the injection of fluids from pumps 100. Gauges 102 are located on the wellhead 46 and are controlled from a unit 104 which also collects the data from the gauges 102. Gauges 102 include a temperature gauge, a pressure gauge and a rate gauge. All of these surface components are standard at a wellhead 46.

For the present invention, downhole gauges 106 must also be fitted. Such downhole gauges 106 are known in the industry and are run from unit 104 at surface 26, to above the production packer 76. Data is transferred via a high capacity cable 108 located in the annulus 78. The gauges 102,106 may be standard gauges though, for the present invention, the gauges 102,106 must be able to record, at least the downhole pressure 110 data at a high acquisition rate. This rate will be at a frequency of at least 1 Hz, so that a data point can be collected at a rate of at least one point per second. As most gauges are now digital, this may simply require increasing the acquisition frequency on the gauge. The unit 104 may collect the data locally and transmit this to an operating base (not shown) where the data analysis can be performed. It is accepted that the downhole pressure gauge will not survive pumping the aqueous fluid 64 and proppant 66 mix in the final cycle 124. However, as the method 10 calculates the volume of proppant 66 required, downhole measurements are not required for the final cycle 124.

In traditional hydraulic fracturing, the frac job 56 requires 20 to 50 pumps 100 at surface 26 to provide an injection rate of 50 to 200 bpm. In the present invention, only one or two pumps 100 are required. This is because an injection rate of less than 15-bpm is required. In a preferred embodiment the pump(s) 100 are high pressure accurate low rate pumps. The accuracy is required to dispense desired low rates of fluid i.e. below 2 bpm through the conduit 98 into the completed wellbore 44. The more typical high pressure high rate pumps can be used for pumping aqueous fluid and proppant in the final stage of the method 10.

With the well 22 prepared as detailed in FIG. 2, the stimulation method 10 of the present invention can be implemented. Returning to FIG. 1, an aqueous fluid 64 is injected at a first injection rate Q1 114*a*, for a duration ti1 116*a* and then the well 22 is shut-in 118*a* for a period tsi1 120*a*. This is considered as a cycle 122*a*. Further cycles 122*b-d* with potentially differing injection rates 114*b-d*, durations 116*b-d* and shut-in periods 120*b-d* follow. The method 10 ends with a final cycle 124, where aqueous fluid 64 and a proppant 66 are injected at a rate Qp 126 for a duration tp 128 and shut-in for a period tsip 130. Though the method 10 on FIG. 1 shows four aqueous fluid 64 injection cycles 122*a-d*, the number required will be dependent on an analysis of the data collected from previous cycles 122.

In traditional hydraulic fracturing the aqueous fluid must be fresh water or a water with low salinity. Friction reducing additives are also combined with the water—i.e. so called slick-water—or the water may be viscosified—i.e. so called frac gels. Getting large quantities of fresh water to site and the cost of additives make traditional hydraulic fracturing expensive. In the present invention, the aqueous fluid 64 does not require to be fresh water nor have friction reducing additives. Indeed aqueous fluid 64 can be seawater or produced water from other wells. Thus back produced water from a stimulated well 22 can be used for the frac jobs 56 on the next or neighbouring well 22. Additionally produced water from conventional wells may also be used. The only requirement for the present invention is that the aqueous fluid 64 is cooled. By this we mean that the temperature of the injected fluid at shut-in must be lower than the formation temperature to provide a temperature differential and induce thermal stress. Such cooling can be achieved by having a lag time before injecting the produced water/fluid into the well. The water may also be treated with bactericide to avoid souring of the formations by bacteria.

Figure 4A:
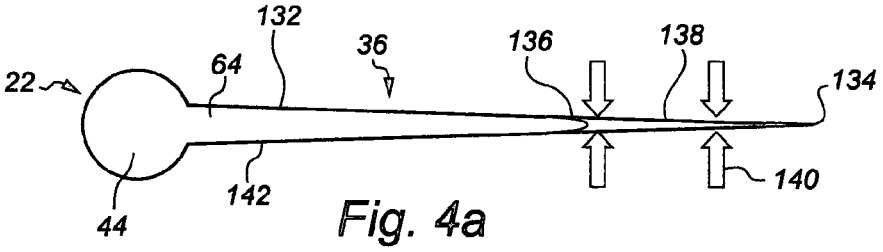
FIG. 4(*a*) is a schematic illustration of injected fluid entering a fracture and FIG. 4(*b*) is a corresponding graph illustrating the swelling stresses during injecting.
Figure 4B:
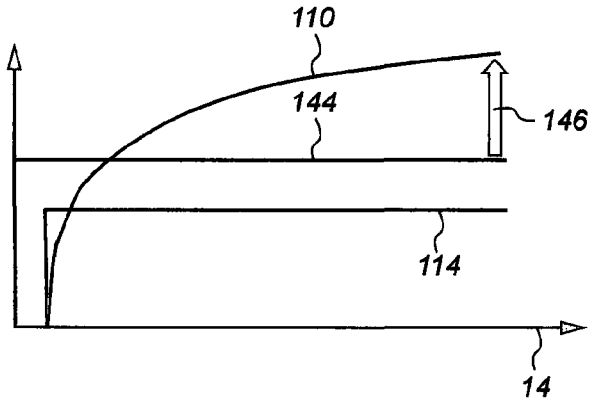

Referring to FIG. 4(*a*), there is an illustration of what occurs when the aqueous fluid 64 is injected into the formation 36. The fluid 64 enters the well 22 by being pumped through the borehole 44. At a perforated interval there will be large lateral fractures, typically referred to as 'half-wing' fractures 132. These fractures tend to be wide and short in lateral extent. On injecting the fluid 64, the fluid enters the fracture 64 travelling towards the fracture tip 134 at the distal end. As the aqueous fluid front 136 flows through the fracture 132, "void" is created between the fluid front 136 and the tip 134. Cavitation occurs giving water vapour 138 and a resultant swelling stress 140 acts against the wall 142 of the fracture 132. FIG. 4(*b*) graphically illustrates this in time 14. There is a minimum in-situ stress 144 which can be considered as constant. The injection rate 114 may also be considered as constant. The injected fluid 64, increases the downhole pressure 110 due to the cavitation resulting in a downhole pressure 110 which is greater than the in-situ stress 144. The net pressure 146 is due to the swelling stresses 140.

Figure 5A:
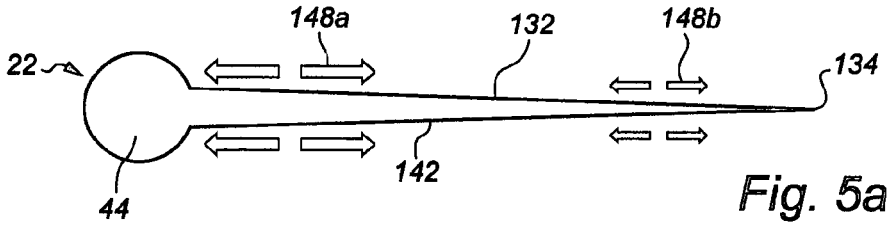
Figure 5B:
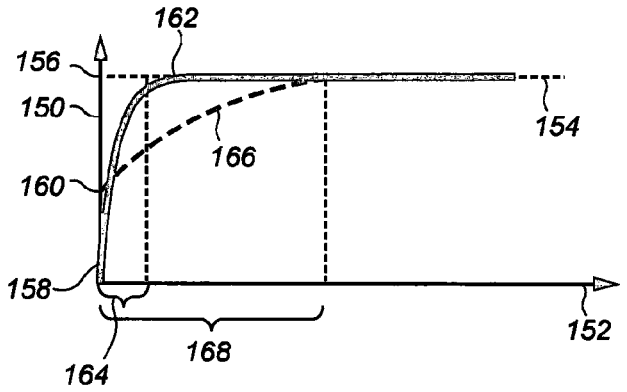

At shut-in 118, thermal stresses 148 will act on the fracture 132 as illustrated in FIG. 5(*a*). Larger thermal stresses 148*a* act along the wall 142 nearest the borehole 44 as the fluid 64 here is cooler at shut-in than the warmer fluid near the tip 134 where smaller thermal stresses 148*b* occur. The thermal stresses 148 represent a thermal component of stress which works along the fracture wall 142 i.e. fracture boundary, which weakens it, so allowing fractures to be formed orthogonally to the fracture wall 142. FIG. 5(*b*) gives a graphical illustration of what temperature changes are occurring in the formation 36 at the fracture 132. Considering temperature 150 versus distance 152 from the fracture 132 (orthogonal), we have a formation or virgin temperature 154 which is given as a constant value 156. As the fluid 64 is cooled, the temperature 150 at the fracture 132 will be at a value 158 much lower than the virgin temperature value 156 at shut-in. However, the temperature profile at shut-in rises to the virgin temperature 156 over a short distance 164 from the fracture 132. The thermal stresses 148 at shut-in may be considered as 'early shallow' stresses. By leaving the well 22 shut-in for a period 120, the temperature profile moving from the fracture 132 will change. The resulting profile at the end of shut-in 166, shows a temperature value 160 at the fracture 132 which is between the temperature value 158 at shut-in and the virgin temperature 156. The profile 166 is then shallower taking a further distance 168 from the fracture 132 to reach the virgin temperature 156. Thus there is now 'late deep' thermal stresses 148 induced which cause the creation of fractures orthogonal to the wall 142 of the fracture 132.

As tensile failure of the formation 36 is achieved with low injection rates 114 the method 10 is essentially a-seismic. This means that the method 10 creates fractures which are not recordable by seismic arrays, such tilt meters and the like being the common techniques for measuring fractures. Thus the method 10 of the present invention can be used where natural fractures do not exist—e.g. in Clay rich formations usually qualified as "unfrackable" in prior art. The method 10 can create fractures and, more particularly, a fracture network 16 which is entirely 'man-made' so that a so-called 'sweet spot' can be created at any location in a formation 36.

The resulting fracture network 16 is illustrated in FIG. 6. From the borehole 44 there is seen a network of very high conductivity fractures 20 which have been created by subsequent injection cycles 122. The fractures 18 appear orthogonal to each other, showing creation by tensile failure due to thermal stress along a fracture surface compared to the random pattern as would be seen by natural and incipient fracture networks. Emanating from the very high conductivity fractures 20 are high conductivity fractures 18. The thermal stresses 148 show a highly dense network 16 of fractures 20,18 close to the borehole 44 whose denseness reduces as you move away from the borehole 44. In some cases there appears to be three zones of permeability centred at the borehole 44. On injecting the proppant 66 with fluid 64 on the final cycle 124, the proppant volume and grain size has been determined so that all the very high conductivity fractures 20 will be filled with proppant, whilst avoiding any possibility of screen-out. During production of hydrocarbons, the propped very high conductivity fractures 20 are the main conduit of permeability. The high conductivity fractures 18 of the injection cycles 122, are now low conductivity fractures which will partly close but still contribute to feeding hydrocarbons to the main fluid conduits.

For each injection cycle 122*b-d*, it is advantageous to determine a number of fracture parameters in order to assist in the selection of the injection rate of each injection cycle 122, the duration of injection 116, and the duration of each shut-in period 120. The fracture parameters which are determined after each injection cycle of aqueous fluid 122 are:

(a) The volume of very high conductivity fractures;

(b) The lateral extension of the very high conductivity fractures;

(c) The surface of the very high conductivity fractures; and (d) The estimation of the global fracture network shape.

Figure 7:
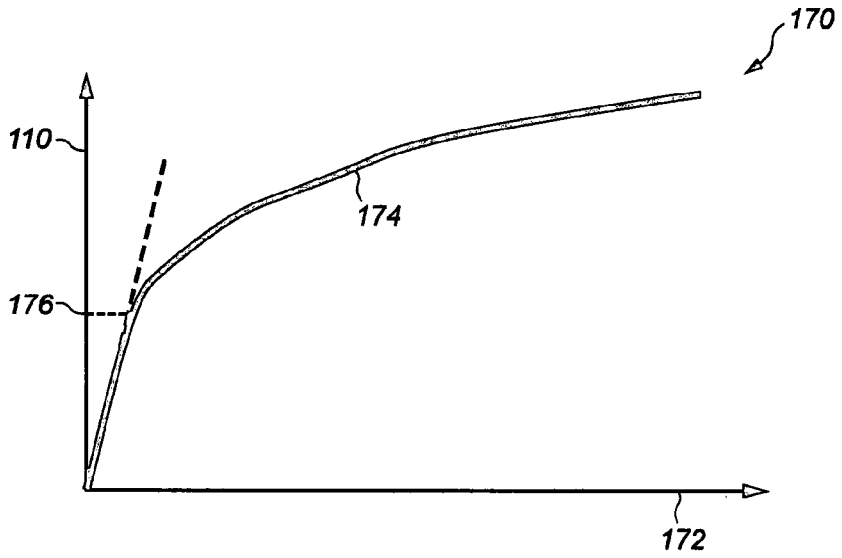
FIG. 7 is a graph of downhole pressure versus injected volume analysed to determine the volume of very high conductivity fractures according to an embodiment of the present invention.

Reference is now made to FIG. 7 which shows a graph 170 used to determine the volume of the very high conductivity fractures. Graph 170 shows the measured downhole pressure 110 against injected volume 172 at the start of a cycle 122. This shows a curve 174 which rises sharply in a straight line at a fixed gradient before tailing off towards the horizontal. The point 176 that the curve 174 tails off reflects a reduction in downhole pressure caused by the creation of one or more fractures. Point 176 may be referred to as the Leak-Off Pressure (PLOT). Those skilled in the art will recognise that the fixed gradient at point 176 is equivalent to the volume by use of the compressibility equation. Such an equation is known to those skilled in the art. In order for these measurements to be made, the injection rate 114 of aqueous fluid 64 is in the range of 0.5 to 2 bpm and the data collection rate of the downhole pressure gauge is between 1 and 10 Hz at the start of the cycle 122.

As illustrated in FIG. 6, the proppant 66 is injected to fill the volume of the very high conductivity fractures 20 during the final cycle 124. As we have just determined the volume of the very high conductivity fractures, we can determine the volume of the proppant 66 required. Calculating the volume of proppant 66 makes the method more efficient as only the required amount is mixed and used. Screen-out is also prevented. The volume of proppant is selected to be in the range of 30% to 70% of the volume of the very high conductivity fractures, so that the remaining percentage is aqueous fluid 64 used to carry the proppant 66 into the very high conductivity fractures 20.

Figure 8:
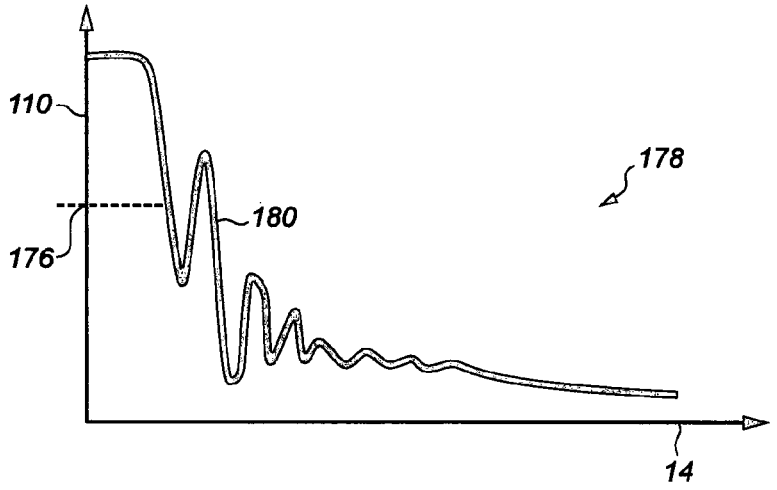
FIG. 8 is a graph of downhole pressure versus time analysed to determine the lateral extension of very high conductivity fractures according to an embodiment of the present invention.

Reference is now made to FIG. 8 of the drawings which shows a graph 178 used to determine the lateral extension of the very high conductivity fractures. Graph 178 shows downhole pressure 110 against time 14 at shut-in 118. The injection rate 114 of aqueous fluid 64 is in the range of 1 to 2 bpm and the data collection rate of the downhole pressure gauge is between 10 and 100 Hz at shut-in 118 of each cycle 122, or at least for the first minute. If the shut-in is done quickly, the graph 178 will show a water hammer pressure wave 180 with peaks and troughs illustrating the reflections of the water hammer pressure wave from stiff reflectors in the well 22 and the formation 36. If the shut-in is slow then the hammer wave 180 will be too truncated. This wave 180 can be considered in the same way as the sound wave in seismic. By treating the wave 180 with a fast Fourier Transform, frequency components of the Transform can be interpreted in terms of the distance of the reflector to the downhole pressure gauge, using the speed of sound in the aqueous fluid, to give distances equivalent to the lateral extension of the very high conductivity fractures. The lateral extension gives an indication of the volume of the formation from which hydrocarbons can be extracted and, as discussed above, it is fractures with sufficient lateral extension which give hydrocarbon production.

Figure 9:
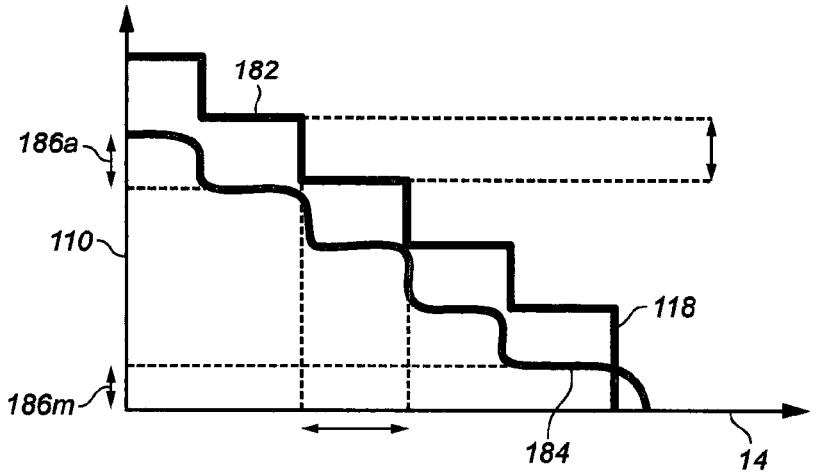
FIG. 9 is an illustrative graph of downhole pressure and injection rate versus time used to determine differences in friction loss for the calculation of the surface of very high conductivity fractures according to an embodiment of the present invention.
Figure 10:
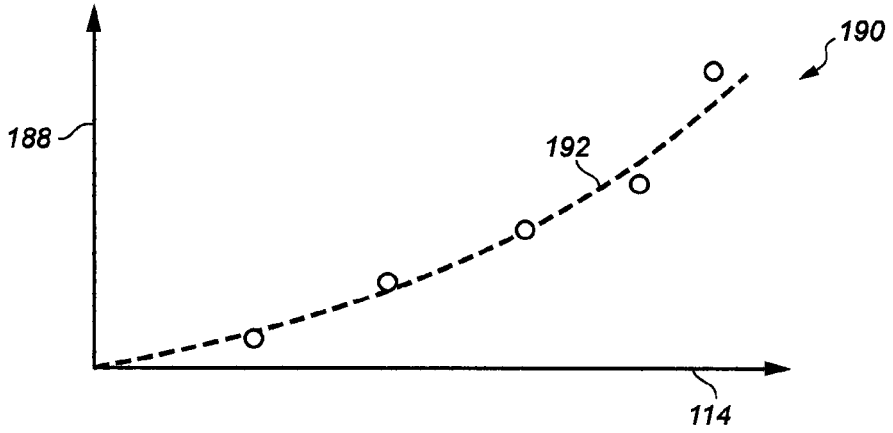
FIG. 10 is a graph of friction loss versus injection rate with a polynomial best fit analysed to determine the surface of the very high conductivity fractures according to an embodiment of the present invention.

We next require a determination of the surface of the very high conductivity fractures. The larger the surface, the more fractures can be created by thermal stress. To achieve this, the shut-in 118 is conducted in a step-wise manner. After the duration 116 of injected aqueous fluid 64, the injection rate 114 is reduced in steps of around 1 bpm with step durations of 1 to 5 minutes. The data acquisition frequency is set between 1 and 10 Hz. The last step to stop injecting is what is used for obtaining the hammer wave 180, in FIG. 8. The steps of the injection rate 182 are illustrated on FIG. 9, to match the steps occurring in the downhole pressure 110 with time 14, resulting from the step-wise shut-in. The curve 184 is used to determine the pressure difference 186 across two steps of rate. A calculation of friction loss 188 is then made to provide a friction loss 188 versus injection rate plot 190. Plot 190 is illustrated in FIG. 10. A polynomial best fit curve 192 is calculated. Knowing the volume of very high conductivity fractures 20, FIG. 7, and their approximate shape, FIG. 8, the polynomial best fit curve 192 is used to derive, the number of very high conductivity fractures 20, the surface area between the fracture network 16 and the rock matrix in the formation 36 and the average aperture of the very high conductivity fracture 20. The average aperture of the very high conductivity fracture 20 may be used to determine the proppant size. By selecting the size of each granule of proppant to be less than or equal to the average aperture, we can be sure that the very high conductivity fractures 20 will be tightly filled and thus be well propped. By selecting the size of granules of proppant 66, the final injection stage 124 is made more cost efficient and optimised as compared to the prior art.

Figure 11:
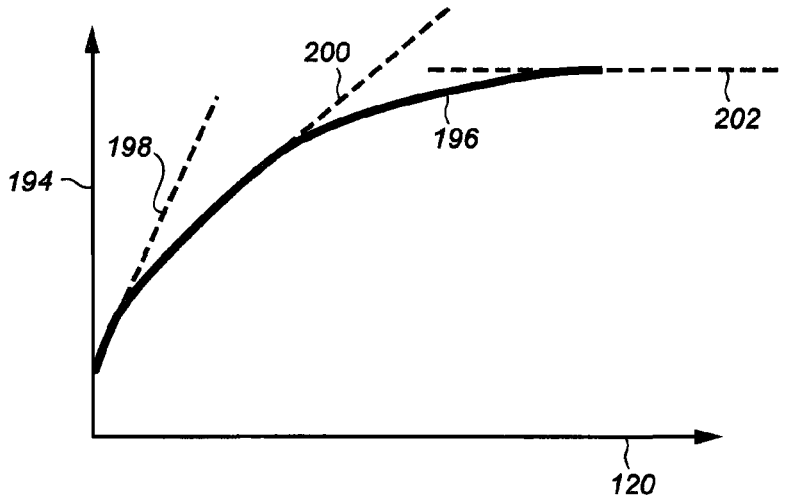
FIG. 11 is a graph providing a characteristic curve which can be analysed to give qualitative assessment of the fracture network geometry.

The estimation of the global fracture network shape is qualified by establishing a characteristic curve for each shut-in 118. Preferably the shape is followed up in real-time after each injection cycle. A semi-log derivative of downhole pressure 110, is plotted against shut-in time 120, with the derivative 194. A characteristic curve 196 is illustrated in FIG. 11. Preferably the curve provides three slopes 198,200, 202, with the duration of each slope indicating a duration of pressure diffusion. The first slope 198 at shut-in indicates pressure diffusion in a planar fracture; the second slope 200 indicates pressure diffusion in a planar fracture and in orthogonal fractures; and, the third slope 202 indicates pressure diffusion in a "pseudo" isotropic fracture network. On completion of each cycle 122*a-c*, the characteristic curve 196 is analysed, and the injection rate 114, injection duration 116 and shut-in period 120 are adapted for the subsequent injection cycle 122*b-d*, to modify the next characteristic curve. The aim being to minimize the duration of the initial two slopes 198,200 on subsequent cycles 122 of injecting the aqueous fluid 64 so that the largest pressure diffusion is across the ideal pseudo isotropic fracture network 16 that has been formed.

In an embodiment of the present invention, the injection cycles 122 of cooled aqueous fluid 64 will take a two week period with the final cycle 124 of aqueous fluid 64 and proppant 66 taking only a few hours.

The method 10 can be applied at individual intervals of a completed well as shown in FIG. 2, either when the well is initially completed and each interval is perforated i.e. the method is the primary hydraulic fracturing technique or after the well has been hydraulically fraced using traditional methods, this would be considered as re-fracing. Such re-fracing would access the hydrocarbons at intervals having a lack of fractures with sufficient lateral extension.

The principle advantage of the present invention is that it provides a method of increasing hydrocarbon production by hydraulic fracturing in a well which creates an isotropic fractured network with sufficient lateral extension for hydrocarbon production in an a-seismic process.

A further advantage of the present invention is that it provides a method of increasing hydrocarbon production by hydraulic fracturing in a well which requires a reduced number of pumps as compared to traditional hydraulic fracturing methods.

A yet further advantage of the present invention is that it provides a method of increasing hydrocarbon production by hydraulic fracturing in a well which can use any available water supply, even produced water from neighbouring conventional or unconventional wells.

The still further advantage of the present invention is that it provides a method of increasing hydrocarbon production by hydraulic fracturing in a well which creates a man-made 'sweet spot' at an interval in a well.

Modifications may be made to the invention herein described without departing from the scope thereof. For example, it will be appreciated that some Figures are shown in an idealised form and that interpretation of the graphs may require a valued judgement in order to determine the injection rate, injection duration and shut-in period for the subsequent injection cycles. Additionally, in the description herein we have considered a completion where the tubing is cemented in place providing a cement sheath which is perforated to expose the formation. Those skilled in the art will recognise that there are other completion methods available providing alternative ways of exposing the formation to the conduit of the production tubing. External packers may also be deployed to isolate each interval and production zone from its neighbours. The formation may be exposed by opening valves or moving sliding sleeves to expose slotted sections of the production liner (i.e. a perforated liner) to allow passage of fluids between the formation at an interval and the inner conduit of the production tubing.

The invention claimed is:

1. A method of increasing hydrocarbon production by hydraulic fracturing in a well, the well having at least one perforated interval exposing rock in a formation and at an interval, the method comprising the steps of: injecting an aqueous fluid into the formation followed by injecting an aqueous fluid and proppant into the formation, characterised in that:

there are a plurality of cycles of injecting the aqueous fluid followed by injecting the aqueous fluid and a volume of proppant in a single cycle with each cycle terminating in a shut-in period;

the volume of proppant is determined from measurement of downhole pressure;

and the process is a-seismic in that the injection rate is low to prevent shocking the formation and the temperature of the injected aqueous fluid is low to induce tensile failure in the rock and thereby provide a fracture network of very high conductivity fractures and high conductivity fractures with sufficient lateral extension for hydrocarbon production.

2. A method according to claim 1 wherein the injection rate for pumping the aqueous fluid is less than 15 bpm (barrels per minute).

3. A method according to claim 1 wherein for one or more cycles the injection rate is less than 2 bpm.

4. A method according to claim 1 wherein the injection rate varies in each cycle.

5. A method according to claim 1 wherein the temperature of the aqueous fluid is sufficient to create the thermal stress required to form new fractures.

6. A method according to claim 1 wherein the aqueous fluid is cooled before injection.

7. A method according to claim 1 wherein the temperature of the aqueous fluid is lower than a temperature of the formation at the interval.

8. A method according to claim 1 wherein the injection rate for pumping the aqueous fluid, injection duration, pressure and shut-in period duration for each cycle are determined from analysis of fracture parameters calculated from previous cycles.

9. A method according to claim 8 wherein the fracture parameters are selected from a group comprising one or more of: volume of the very high conductivity fractures, lateral extension of the very high conductivity fractures, surface of the very high conductivity fractures and estimation of the global fracture network shape.

10. A method according to claim 9 wherein all the fracture parameters are calculated after each injection cycle of the aqueous fluid.

11. A method according to claim 1 wherein the downhole pressure is measured using a downhole pressure gauge located in the well and wherein the downhole pressure gauge has a data collection rate of at least 1 Hz.

12. A method according to claim 1 wherein, at shut-in, the injection rate is reduced in a step-wise manner.

13. A method according to claim 12 wherein the injection rate at a final step prior to final shut-in is less than 2 bpm.

14. A method according to claim 12 wherein each step is completed in around 1 to 5 minutes.

15. A method according to claim 1 wherein, at a start of each cycle, the injection rate of aqueous fluid is less than 2 bpm.

16. A method according to claim 1 wherein the volume of proppant is determined from the calculation of the volume of the very high conductivity fractures.

17. A method according to claim 1 wherein the aqueous fluid is water.

18. A method according to claim 17 wherein the aqueous fluid is produced water from another well.

19. A method according to claim 1 wherein the method includes the steps of plugging the interval, perforating and stimulating subsequent intervals along the well bore using the injection cycling steps of any preceding claim, unplugging the well, back producing the aqueous fluid and producing hydrocarbons.

20. A method according to claim 1 wherein the method is performed at intervals which have previously been stimulated by hydraulic fracturing.

* * * * *